United States Patent [19]

Tabata

[11] 4,332,877

[45] Jun. 1, 1982

[54] ELECTROPHOTOGRAPHIC COPYING METHOD

[75] Inventor: Yasuhiro Tabata, Kawasaki, Japan

[73] Assignee: Ricoh Company, Ltd., Tokyo, Japan

[21] Appl. No.: 108,150

[22] Filed: Dec. 28, 1979

[30] Foreign Application Priority Data

Dec. 29, 1978 [JP] Japan ..... 53/165267

[51] Int. Cl.[3] ..... G03G 13/06; G03G 13/10

[52] U.S. Cl. ..... 430/103; 355/14 D; 355/14 R

[58] Field of Search ..... 355/3 R, 14 R, 14 D, 355/14 E, 55, 56, 77; 430/103

[56] References Cited

U.S. PATENT DOCUMENTS 4,035,069 7/1977 Yano ..... 355/14 E X

FOREIGN PATENT DOCUMENTS 2854448 6/1979 Fed. Rep. of Germany ... 355/14 D

*Primary Examiner*—Fred L. Braun

*Attorney, Agent, or Firm*—Wyatt, Gerber, Shoup, Scobey & Badie

[57] ABSTRACT

In an electrophotographic copying apparatus having an exposure optical system capable of performing variable magnification of copies to be made by changing the relative movement speed of an original and an image scanning optical system to 1/m in accordance with the magnification m of copies to be made from the original and changing the optical position of an optical system for forming an image on a photoconductor in accordance with the magnification m, and projecting a light image of the original to the photoconductor which is moved at a predetermined speed, so that a variably magnified latent electrostatic image is formed on the photoconductor, an electrophotographic copying method including a step of changing a development bias voltage at the development of the latent electrostatic image in accordance with each magnification.

3 Claims, 6 Drawing Figures

ELECTROPHOTOGRAPHIC COPYING METHOD

BACKGROUND OF THE INVENTION

This invention relates to an electrophotographic copying method and more particularly to a variable-magnification electrophotographic method.

In a conventional electrophotographic copying machine having a slit exposure optical system capable of performing variable magnification of copy size, the relative movement speed of an original and an optical system for image scanning of the original is changed to 1/m in accordance with the magnification m of a copy to be made from the original and, at the same time, the optical position of an optical system for forming the image of the original on a photoconductor is also changed in accordance with the magnification m, and a light image of the original is projected on the photoconductor which is moved at a predetermined speed so that a magnified latent electrostatic image is formed on the photoconductor.

In this type of variable magnification copying apparatus, since a unit magnified copy, an enlarged copy and a reduced copy can be made from the same original, it is possible to obtain copies with a predetermined size from originals with different sizes. However, smearing of the background and lowering of image density of the enlarged copies or reduced copies tend to become more conspicuous in comparison with the unit magnified copies. This tendency is caused by a change of the surface potential of the photoconductor since the exposure light quantity of the light image of the original to be projected on the photoconductor changes, depending upon the magnification or reduction of the copy size for the original.

More specifically, in the slit exposure apparatus, the illuminance E(m) of a light image on the photoconductor can be represented by the following equation (1) when the magnification is m:

$$E(m) = \frac{C_1}{(1 + m)^2} \tag{1}$$

wherein $C_1$ is a constant which is determined by the brightness of a light source, illumination efficiency, F/No. of an exposure lens, the number of reflectors and the reflection efficiency of each reflector and the kind of original to be copied.

Furthermore, when the exposure time is T(m) at the magnification m, the illuminance A(m) on the photoconductor is represented by the following equation (2).

$$A(m) = E(m) \cdot T(m) \tag{2}$$

Note that when the slit width of the exposed light image is set at a predetermined value on the photoconductor side, the exposure time T(m) does not depend upon the magnification m and therefore the exposure time T(m) can be substituted by a constant $C_2$ which is determined by the ratio of the slit which formed on the photoconductor to the relative scanning speed of the photoconductor.

Hence, the equation (2) can be represented by the following equation (3):

$$T(m) = C_2 \tag{3}$$

Substituting the equation (3) and the equation (1) in the equation (2), the illuminance A(m) on the photoconductor is represented by the following equation (4):

$$A(m) = \frac{C_1 C_2}{(1 + m)^2} \tag{4}$$

FIG. 1 shows the illuminance A(m) of the photoconductor. In FIG. 1, the numbers on the ordinate indicate the relative exposure light quantity when the exposure light quantity at the unit magnification is 1.0, and the numbers on the abscissa indicate the magnification m.

As can be seen from FIG. 1, the exposure light quantity on the photoconductor increases when the original image is reduced, and decreases when the original image is enlarged.

Referring to FIG. 2, there is shown a relationship between the exposure light quantity on a photoconductor and the surface potential of the photoconductor, which indicates that as the exposure light quantity increases, the surface potential of the photoconductor decreases (refer to Electrophotography by R. M. Schaffert, M.A., Ph.D.).

Therefore, when the enlarged image or reduced image of an original is developed under the same condition as that for the unit magnification copying, particularly in the case of the reduced image, its image density becomes lower than that of the unit magnification copy, since the exposure light quantity on the photoconductor is higher than that in the case of the unit magnification copy. On the other hand, in the case of enlarged image, the smearing of the background becomes more conspicuous in comparison with that in the unit magnification copying, since the surface potential of the photoconductor is higher than that in the case of unit magnification copying.

In the variable magnification copying machine, even if a variable magnification function is simply added to the conventional unit magnification copying machine, it has a shortcoming that image quality of each copy changes depending upon the variation of the copy magnification.

As the other conventional variable magnification copying machines, the following types have been proposed: In one type of copying machine, the change of image quality caused by the change of magnification is ignored. In another type of copying machine, in order to prevent change of image quality caused by the change of magnification, the exposure to the photoconductor is performed through a slit and the width of the slit is changed in accordance with the magnification so that the exposure light quantity on the photoconductor is made constant irrespective of the magnification. In a further conventional copying machine, the illuminance on the photoconductor is kept constant by changing the illuminance of the lamp used for projecting the original image, in accordance with the magnification.

However, in the method of changing the width of the slit in accordance with the magnification, the slit width is narrowed in order to eliminate the shortcoming that the exposure light quantity increases when reducing the original image, and this causes diffraction of light, and a jitter of image is caused by the relative movement of the exposure optical system and the original in the scanning of image.

In the method of changing the illuminance of the illumination lamp for the original according to the change of magnification, the color temperature of the lamp changes with the change of the illuminance of the lamp and when making copies of colored originals or color copies, the change of the color temperature changes the lightness and color tone of the image.

Furthermore in the method of changing the slit width in accordance with the magnification using a copying machine having an image scanning optical system in which it is difficult to set a constant slit, more specifically in a copying machine as shown in FIG. 3, in which an image is formed on a photoconductor 3 by an exposure optical system 2 which scans fanwise over an original 1, the scanning speed of the exposure optical system 2 over the surface of the original 1 is not constant so that if a slit is formed on the side of the original 1, the scanning mechanism of the exposure optical system 2 becomes extremely complex, and if the slit is formed on the side of the photoconductor 3 in this apparatus, the optical path of a light image with respect to the photoconductor drum 3 changes in the course of the scanning and therefore, by forming a slit 4 as shown in FIG. 4, the width of the ray of light changes from $\lambda_0$ to $\lambda_1$, which makes the matter worse.

Thus, the method of preventing the change of the surface potential of the photoconductor, which is caused by the change of magnification, by correcting the exposure light quantity has a shortcoming that the application of the method is limited to a special copying machine or a copying machine whose magnification range is small.

SUMMARY OF THE INVENTION

It is an object of the invention to provide a method of obtaining copies with a constant image quality at any magnification without correcting the exposure light quantity.

According to the invention, in an electrophotographic copying apparatus having an exposure optical system capable of performing variable magnification of copies by changing the relative movement speed of an original and an image scanning optical system to 1/m in accordance with the magnification m of copies and changing the optical position of an optical system for forming an image on a photoconductor according to the magnification m, and projecting a light image of the original to the photoconductor which is moved at a predetermined speed, so that a variably magnified latent electrostatic image is formed on the photoconductor, a development bias voltage at the development of the latent electrostatic image is changed in accordance with each magnification.

According to the invention, since the image quality of variably magnified copies is stabilized by changing the development bias voltage in accordance with the change of the magnification. Therefore, the range of its application is broadened in comparison with a conventional variable-magnification copying apparatus in which the image quality is stabilized by correcting the exposure depending upon the magnification, and the range of the magnification is also broadened.

DESCRIPTION OF THE PREFERRED EMBODIMENTS

Figure 5:
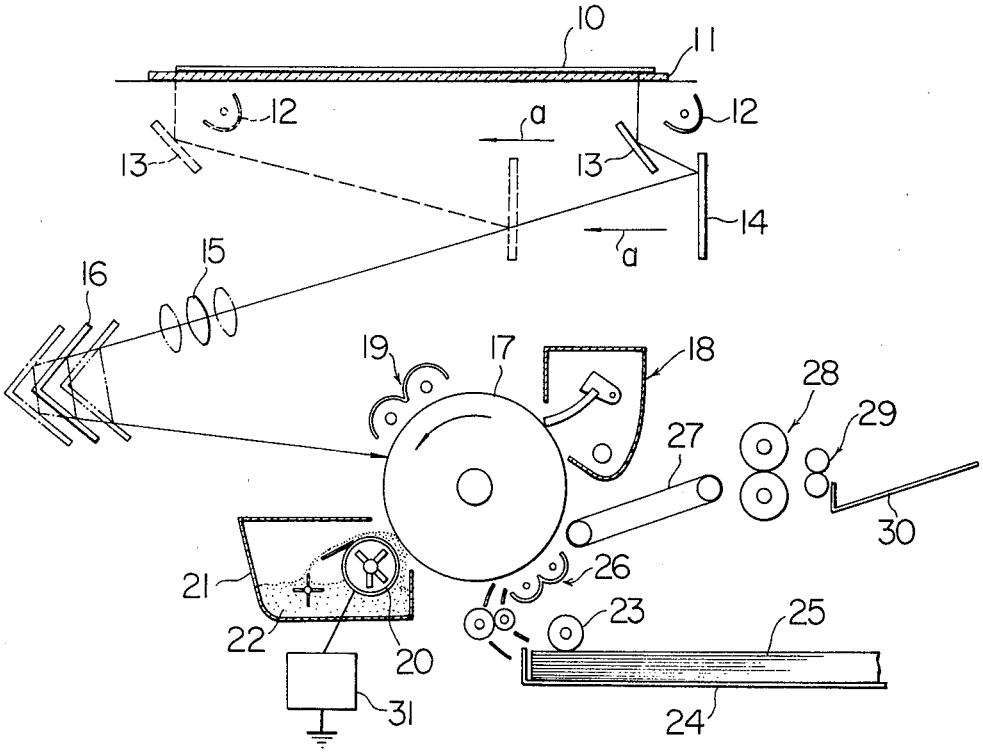
FIG. 5 is a diagrammatical side view of an electrophotographic copying machine in which an embodiment of an electrophotographic copying method of the invention is employed.

Referring to FIG. 5, there is shown an embodiment of an electrophotographic copying method of the invention, which is employed in a dry type electrophotographic copying machine of the type of moving an exposure optical system with respect to a stationary original. In FIG. 5, an original 10 is placed on a contact glass 11. The image of the original 10 is illuminated by a lamp 12 and a light image of the original 10 is led to a first reflector 13. When the copy magnification is m, the first reflector 13 and the lamp 12 are moved in the direction of the arrow a at a speed of V/m so that the image of the original 10 is scanned, wherein V is the relative speed of the original 10 and the reflector 13 at unit magnification. The light image of the original 10 is formed on the surface of a photoconductor drum 17 through a second mirror 14, a lens 15 and a third reflector 16. The second reflector 14 is also moved in the direction of the arrow a at a speed of V/2 m which is a half of the speed of the second reflector 14. Furthermore, the lens 15 and the third reflector 16 are moved to a predetermined position and held there in accordance with the magnification m. More specifically, in the case of enlargement, the lens 15 and the third reflector 16 are moved and stationed at such a position where the length of an optical path of the light image on the side of the photoconductor 17 is longer than that on the side of the original 10. In the case of reduction, the lens 15 and the third reflector 16 are positioned in such a manner that the length of the optical path of the light image on the side of the photoconductor drum 17 is shorter than that on the side of the original 10.

In the meantime, the photoconductor drum 17 is rotated prior to the scanning of the original 10 and the surface of the photoconductor drum 17 is cleaned by a cleaning apparatus 18 and the cleaned surface of the photoconductor drum 17 is uniformly charged by a charger 19. The charges on the surface of the drum 17 in a portion corresponding to a non-image area of the original 10 are conducted away from a photoconductive layer of the surface of the drum 17 by the illumination of the reflected light of the lamp 12.

The charges on a portion of the drum 17 corresponding to an image area of the original 10 remain since the reflected light of the lamp 12 is absorbed by the image of the original 10 and the corresponding portion is not illuminated, so that a latent electrostatic image corresponding to the original image is formed on the surface of the photoconductor drum 17.

The latent electrostatic image is successively formed by the illumination of the light image of the above-mentioned process on the drum 17 as it is rotated. The thus formed latent electrostatic image attracts a developer 22 electrostatically thereto, which is supplied from a developer container 21 to the surface of the drum 17 by a development sleeve 20, so that a toner image is formed on the drum 17.

The thus formed toner image is transferred to a sheet 25, which is fed to the peripheral surface of the drum 17 from a sheet feed tray 24, by the action of a image transfer charger 26. The sheet 25 to which the toner image has been transferred is transported into an image fixing apparatus 28 by a transportation belt 27 so that the toner image is fused and fixed to the sheet 25, and the sheet 25 is then discharged onto a sheet discharge tray 30 by sheet discharge rollers 29.

Figure 1:
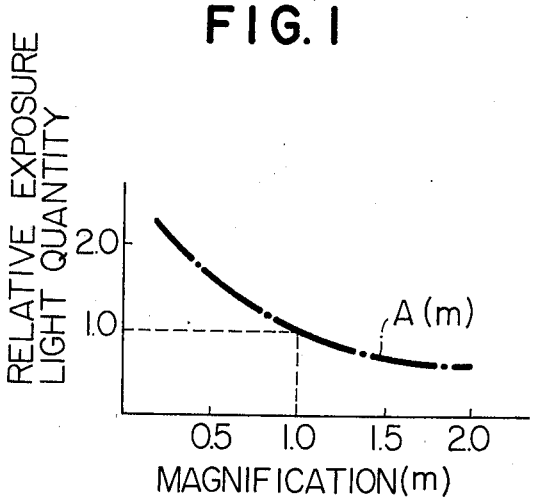
FIG. 1 is a diagram indicating a relationship between the relative exposure light quantity and the magnification in variable-magnification copying.
Figure 2:
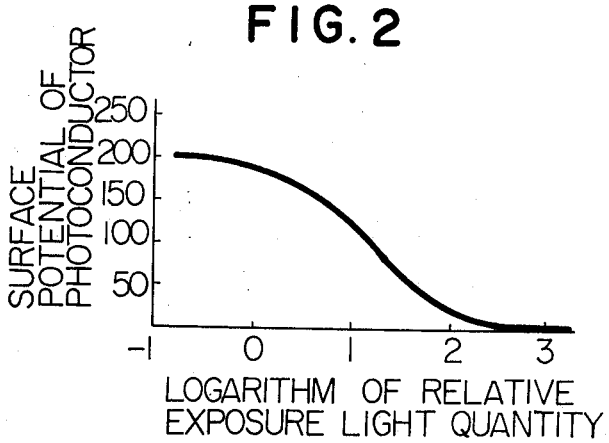
FIG. 2 is a diagram indicating a relationship between the surface potential of a photoconductor and the relative exposure light quantity.
Figure 3:
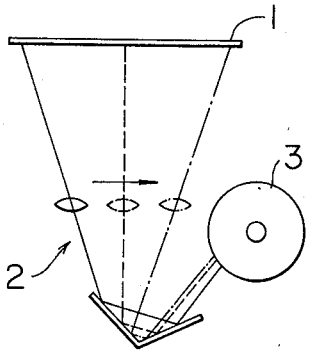
FIG. 3 PRIOR ART
FIG. 3 is a diagrammatical view of an image scanning system.
Figure 4:
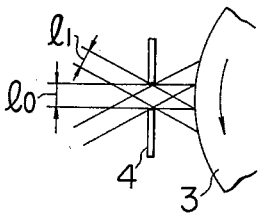
FIG. 4 PRIOR ART
FIG. 4 is a diagrammatical partial enlarged view of the image scanning system of FIG. 3.

As shown in FIGS. 1 and 2, the potential of the latent electrostatic image formed on the surface of the drum 17 changes according to the change of exposure light quantity and the magnification of the light image.

In the conventional variable-magnification copying machine, the image quality is stabilized by correcting the change of the quantity of light of the original image due to variable magnification. In contrast with this, in the invention, the stabilization of the image quality is attained by taking into consideration that a relative change of the surface potential of the photoconductor with respect to a development bias voltage has an effect on the image quality.

In other words, when reducing the copy size, the light quantity of the light image increases in comparison with that at the time of unit magnification so that the potential of the latent electrostatic image decreases. Therefore, when the latent electrostatic image is developed under the same condition as that for unit magnification with a predetermined development bias voltage applied to the development sleeve 20, the image density of the toner image decreases since the development bias voltage becomes relatively higher than the surface potential of the photoconductor drum 17 and the bias effect becomes too strong and it becomes difficult for the toner to be attracted to the drum 17.

On the contrary, when enlarged copies are made, the light quantity of the light image decreases in comparison with that at the time of unit magnification so that the potential of the latent electrostatic image increases and moreover, the charges on the drum 17 corresponding to the non-image area of the original 10 are not completely conducted away from the surface of the drum 17, and some of the charges remain there. As a result, when the latent electrostatic image is developed under the same development bias voltage as that for unit magnification, the development bias voltage becomes relatively lower in comparison with the surface potential of the drum 17 and toner deposition occurs in the background of the copies due to the insufficiency of the bias effect.

Therefore, it becomes possible to stabilize the copied image quality by changing the development bias voltage at the time of variable magnification in accordance with each magnification.

For example, as shown in FIG. 5, a bias voltage is applied to the development sleeve 20 through a bias voltage adjustment apparatus 31.

The bias voltage adjustment apparatus 31 is an apparatus for applying to the development sleeve 20 a bias voltage suitable for the exposure light quantity or the surface potential of a light portion of the photoconductor drum 17, depending upon the change of magnification, and the bias voltage is determined on the basis of measurement results of the exposure or the surface potential of the drum 17 at various magnifications so as to correspond to the change of the exposure light quantity in FIG. 1 or the change of the surface potential of the photoconductor in FIG. 2.

Since various means for changing the bias voltage are already known, various types of the bias voltage adjustment apparatus 31 can be made based on the known techniques or means.

When enlarged copies are made, the bias voltage adjustment apparatus 31 applies a higher bias voltage than that for unit magnification to the development sleeve 20 in accordance with each magnification and when reduced copies are made, the bias voltage adjustment apparatus 31 applies a lower bias voltage than that for unit magnification to the development sleeve in accordance with each magnification, whereby the development bias voltage is suitably set for each magnification and the lowering of image density and smearing of the background are prevented. The bias voltage can be set in synchronism with or independently of each magnification selection operation.

When a constant a is set at a value which satisfies $aV_1=1$, where $V_1$ is the development voltage at unit magnification, namely, $m=1$, the development voltage V is changed in the relationship of $V=(1/a)m$ in accordance with the change of the magnification m.

The effect of the bias voltage can be obtained with both analogue and digital change of the bias voltage. In the case of the analogue change, the bias voltage can be changed either linearly or curvilinearly.

The copying method of the invention has an advantage that it can be applied to any type of electrophotographic copying machines irrespective of the type of the scanning system or exposure optical system and the development method, since the development bias voltage is changed in order to stabilize the image quality at variable magnification of the images.

Figure 6:
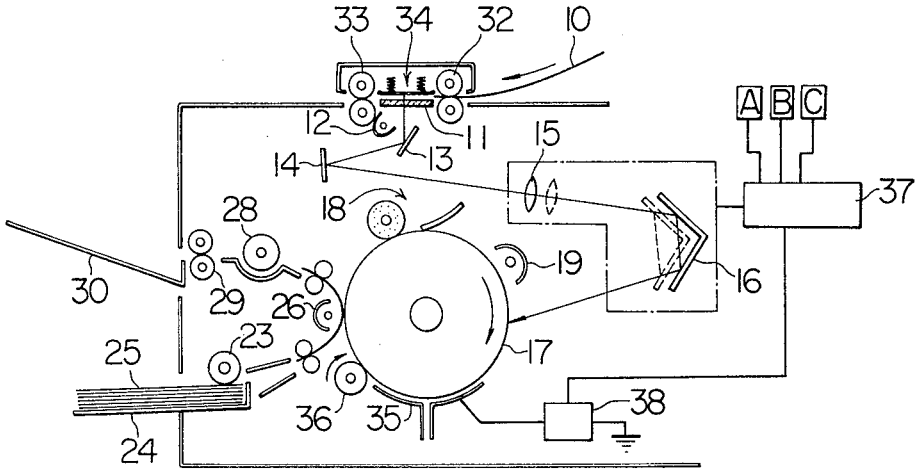
FIG. 6 is a diagrammatical side view of a wet type electrophotographic copying apparatus in which another embodiment of the invention is employed.

Referring to FIG. 6, there is shown a wet type electrophotographic copying machine of the type of performing image scanning by moving the original, in which the invention is employed.

In FIG. 6, similar parts are designated with similar numbers as those in FIG. 5.

The original 10 is fed into the copying machine by sheet feed rollers 32, 33 and the image of the original 10 scanned in a scanning section 34 is projected as a light image on the surface of the photoconductor drum 17 through the first reflector 13, the second reflector 14, the lens 15 and the third reflector 16. By the projection of the light image, a latent electrostatic image is formed on the surface of the photoconductor drum 17 and is then developed to a visible toner image by a developer which is supplied to a development electrode 35 disposed in proximity to the peripheral surface of the drum 17. The toner image is transferred to the transer sheet after excess developer has been removed from the toner image by a squeeze roller 36.

In this copying machine, the magnification of copies can be varied by selecting magnification changing buttons A, B and C. For example, magnification $m=1$ is set by the button, and $m=0.816$ by the button B, and $m=0.707$ by the button C. The buttons for enlargement are not shown in FIG. 6.

When the button B is depressed, for example, the lens 15 and third reflector 16 are moved by the action of a control circuit 37 in accordance with the magnification $m=0.816$ and at the same time, the rotation speed of the sheet feed rollers 32, 33 or the rotation speed of the drum 17 is increased in accordance with the magnification, and a voltage selection signal is input to a bias voltage control circuit 38 from the control circuit and a suitable bias voltage for the magnification m=0.816 is applied to the development electrode 35.

What is claimed is:

1. In an electrophotographic copying method capable of producing copies of a magnification different than that of an original, including the steps of moving a uniformly-charged photosensitive member past an exposure station, moving an optical system relative the original to form a light image thereof at said exposure station to form an electrostatic latent image on said photosensitive member, varying the position and speed of said optical system relative the original for varying the magnification of the latent electrostatic image formed on the photosensitive member, and developing said electrostatic latent image by contacting it with developer in the presence of a developing electrode, the improvement including the step of varying the potential of said developing electrode in accordance with the magnification of said electrostatic latent image.

2. The improvement as defined in claim 1, said potential being lowered when the magnification of said electrostatic latent image is smaller than the original, and said potential being raised when the magnification of said electrostatic latent image is larger than the original.

3. The improvement as defined in claim 1, the potential of said developing electrode being determined by the formula:

$$V=(1/a)M$$

wherein:

a is a constant equal to the reciprocal of the potential of the developing electrode when the size of the electrostatic latent image equals that of the original; and M indicates the magnification of the electrostatic latent image.

* * * * *